US009302482B2

(12) United States Patent
Okano et al.

(10) Patent No.: US 9,302,482 B2
(45) Date of Patent: Apr. 5, 2016

(54) INKJET PRINTING DEVICE

(71) Applicant: Hitachi Industrial Equipment Systems Co., Ltd., Chiyoda-ku, Tokyo (JP)

(72) Inventors: Mamoru Okano, Tokyo (JP); Tomohiro Inoue, Tokyo (JP); Takahiro Arima, Tokyo (JP); Mitsuo Igari, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 14/763,412

(22) PCT Filed: Jan. 29, 2014

(86) PCT No.: PCT/JP2014/051881
§ 371 (c)(1),
(2) Date: Jul. 24, 2015

(87) PCT Pub. No.: WO2014/136501
PCT Pub. Date: Sep. 12, 2014

(65) Prior Publication Data

US 2015/0352845 A1 Dec. 10, 2015

(30) Foreign Application Priority Data

Mar. 8, 2013 (JP) ..... 2013-046084

(51) Int. Cl.

| | |
|---|---|
| ***B41J 2/165*** | (2006.01) |
| ***B41J 2/02*** | (2006.01) |
| ***B41J 2/18*** | (2006.01) |
| ***B41J 2/095*** | (2006.01) |
| ***B41J 2/19*** | (2006.01) |
| *B41J 2/175* | (2006.01) |
| *B41J 2/185* | (2006.01) |

(52) U.S. Cl.
CPC ..... *B41J 2/16505* (2013.01); *B41J 2/02* (2013.01); *B41J 2/095* (2013.01); *B41J 2/18* (2013.01); *B41J 2/19* (2013.01); *B41J 2/175* (2013.01); *B41J 2/185* (2013.01); *B41J 2002/16555* (2013.01); *B41J 2002/1853* (2013.01)

(58) Field of Classification Search
None
See application file for complete search history.

(56) References Cited

U.S. PATENT DOCUMENTS

2012/0001968 A1* 1/2012 Inoue ..... B41J 2/16526 347/7

FOREIGN PATENT DOCUMENTS

| | | | |
|---|---|---|---|
| JP | 60-11364 | A | 1/1985 |
| JP | 2003-4343 | A | 1/2003 |
| JP | 2003-266724 | A | 9/2003 |
| JP | 2009-172932 | A | 8/2009 |
| JP | 2012-153053 | A | 8/2012 |
| WO | WO 2012/111039 | A1 | 8/2012 |

OTHER PUBLICATIONS

International Search Report dated May 13, 2014 with English translation (two (2) pages).

* cited by examiner

*Primary Examiner* — Lisa M Solomon
(74) *Attorney, Agent, or Firm* — Crowell & Moring LLP

(57) ABSTRACT

An inkjet printing device allows separation of ink solvent liquefied in an exhaust passage from exhaust gas, and prevents the separated exhaust gas from contaminating the inside of the print head. When ink fed from a container is jetted from a printing nozzle, ink that has not been used for the printing is drawn by a gutter along with air and collected in the container. Air mixed with the ink solvent and collected is discharged as exhaust gas into an exhaust passage from the container. The ink solvent that has been liquefied in the exhaust passage is separated from the gas by retaining the liquid using capillary action in a gas-liquid separator, and the separated liquefied ink solvent is collected. The trace amount of the ink solvent leaking on the exhaust side of the gas-liquid separator is prevented from dripping into the print head by a drip prevention unit.

7 Claims, 14 Drawing Sheets

INKJET PRINTING DEVICE

TECHNICAL FIELD

The present invention relates to an inkjet printing device which continuously jets ink from the nozzle for printing on the printing object.

BACKGROUND ART

The inkjet printing device of continuous type is configured to continuously jet the ink from the nozzle to charge jetted ink particles in the air, and further deflect the charged ink particles in the electric field so as to perform printing. The inkjet printing device of the aforementioned type has been widely distributed for various purposes of printing numbers and codes on the metal can or the plastic surface.

Patent Literature 1 discloses the inkjet printing device of the aforementioned type as related art. The inkjet printing device includes a main body, a print head, and a conduit for connecting the main body and the print head. The main body is provided with an ink container for storing the ink, a feed pump for feeding the ink from the ink container to the print head, a collection pump for collecting the ink from the print head to the ink container, and a control unit for controlling operations of the printing device.

The print head includes a nozzle that jets the ink fed from the main body in the form of ink particles, a charge electrode for charging the ink particles, a deflection electrode for deflecting the charged ink in the electrostatic field, and a gutter for catching the unused ink. A tube through which the ink flows, and an electric wiring for transmitting an electric signal to the print head are inserted into the conduit that connects the main body and the print head.

The inkjet printing device of continuous type employs the ink solvent with nigh volatility such as methylethyl ketone and ethanol for high speed printing. Upon collection of the ink through the collection pump, the ink is drawn by the gutter along with the ambient air. The thus drawn air is continuously sent into the ink container. It is therefore necessary to discharge the drawn air from the ink container.

The air drawn along with the ink contains volatilized solvent. Therefore, the air drawn by the gutter will be discharged outside the inkjet printing device along with the ink solvent. As the ink solvent is discharged, the ink density becomes high. It is therefore necessary to add the solvent from the solvent container by the amount corresponding to the volatilization amount. The added amount of the solvent is determined in accordance with measured density of the ink in the ink container.

In this way, discharge of the air drawn by the gutter outside the inkjet printing device may apply loads on the environment, leading to increased running costs.

Patent Literature 2 discloses the inkjet printing device including the exhaust line for sending the air discharged from the ink container to the gutter for the purpose of suppressing volatilization of the ink solvent to foe discharged outside the inkjet printing device. The inkjet printing device is configured to circulate the exhaust gas sent to the gutter in the inkjet printing device, thus reducing the ink solvent volatilization amount. The inner temperature of the main body provided with the ink container becomes higher than the inner temperature of the print head by approximately 10° C. to 20° C. under the heat generated by the circuit substrate. Therefore, the exhaust gas temperature is lowered during carriage of the exhaust gas to the gutter, resulting in liquefaction of the solvent.

It is therefore necessary to separate the liquid from the exhaust gas. The separation technique is employed as the gas-liquid separator as disclosed in Patent Literature 3, which is configured to collect the liquid component dripped by gravity.

CITATION LIST

Patent Literature

PTL 1: Japanese Patent Application Laid-Open No. 2009-172932

PTL 2: Japanese Patent Application Laid-Open No. 60-11364

PTL 3: Japanese Patent Application Laid-Open No. 2003-4343

SUMMARY OF INVENTION

Technical Problem

As described above, operation of the inkjet printing device disclosed in Patent Literature 2 may decrease the exhaust gas temperature to liquefy the ink solvent during carriage of the exhaust gas into the gutter. In other words, the ink solvent tends to raise its saturated vapor pressure as the temperature becomes higher. As the temperature in the environment for operating the inkjet printing device becomes higher, the ink solvent is likely to be condensed and liquefied even at the slight temperature decrease from the high temperature. Spilling of the liquefied ink solvent in the periphery of the gutter may cause the risk of contaminating the inside of the print head. Collision of the liquefied solvent against the ink particles for printing may also give an adverse influence on the printing quality.

In order to cope with the aforementioned problem, it is necessary to remove the solvent liquefied in the exhaust gas. The gas-liquid separator disclosed in Patent Literature 3 is used to separate the liquid component from the gas-liquid mixture. However, the gas-liquid separator is configured to collect the liquid component that has been dripped by gravity. Accordingly, change in the direction where the gas-liquid separator is disposed may cause the problem that the separator is unable to separate the liquid from the gas.

The present invention has been made in consideration with the aforementioned circumstances to provide the inkjet printing device configured to allow appropriate separation of the ink solvent liquefied in the exhaust passage from the exhaust gas, prevent contamination of the inside of the print head when the post-separation exhaust gas is returned into the print head, and realize the aforementioned functions at the lower running costs.

Solution to Problem

In order to solve the aforementioned problem, the present invention provides an inkjet printing device which includes an ink container which stores ink, a nozzle which jets the ink for printing on a printing object, a feed pump for feeding the ink from the ink container to the nozzle through an ink supply passage, a gutter which draws the ink jetted from the nozzle and unused for the printing along with air, a print head which stores the nozzle and the gutter, a first collection pump which sends the ink drawn by the gutter along with air to the ink container for collection through an ink collection passage, an exhaust passage which discharges the air as exhaust gas from the ink container, which has been mixed with an ink solvent and collected into the ink container, a gas-liquid separator for separating the exhaust gas from liquefied ink solvent formed by liquefaction of the ink solvent contained in the exhaust gas in the exhaust passage using capillary action, and a second collection pump which sends the liquefied ink solvent separated by the gas-liquid separator for collection into the ink container through an ink separation-collection passage.

There may be the case where the inkjet printing device used under the high-temperature environment increases the amount of the liquefied ink solvent contained in the exhaust gas, and causes the trace amount of the solvent to be dripped into the print head, which has passed through the gas-liquid separator without being separated. However, the inkjet printing device is configured to have the drip prevention unit at the rear stage of the exhaust port of the gas-liquid separator so as to prevent dripping of the solvent.

Advantageous Effects of Invention

The device according to the present invention is capable of appropriately separating the ink solvent liquefied in the exhaust passage from the exhaust gas so as to prevent the post-separation exhaust gas from contaminating the inside of the print head after returning into the print head. The thus structured inkjet printing device may realize those functions at the lower running costs.

DESCRIPTION OF EMBODIMENTS

Figure 1:
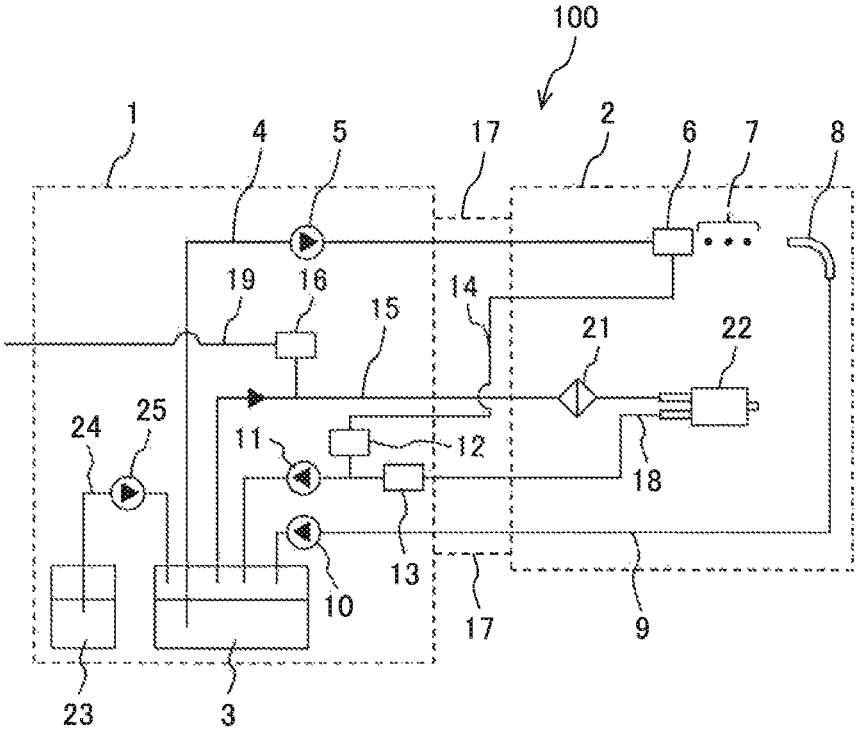
FIG. 1 is a view showing a structure of an inkjet printing device according to an embodiment of the present invention.

Embodiments of the present invention will be described referring to the drawings.

<Structure of Embodiment>

FIG. 1 is a view showing a structure of an inkjet printing device 100 according to an embodiment of the present invention.

Referring to FIG. 1, the inkjet printing device 100 includes a main body 1, a print head 2, and a conduit 17 for connecting them.

The main body 1 includes an ink container 3, a feed pump 5, collection pumps (first and second collection pumps) 10 and 11, electromagnetic valves 12, 13 and 16, an ink supply passage 4 as a passage formed of various conduits, pipes and tubes, an ink collection passage 9, a cleaning passage 14, an exhaust passage 15, an ink separation-collection passage 18, a bypass passage 19, a solvent container 23, a solvent passage 24, and a supply pump 25.

The print head 2 includes a nozzle 6, a gutter 8, an ink mist mixer 21, a gas-liquid separator 22, the ink supply passage 4, the ink collection passage 9, the cleaning passage 14, the exhaust passage 15, the ink separation-collection passage 18, and the bypass passage 19.

The conduit 17 is a piping for connecting the main body 1 and the print head 2, having the ink supply passage 4, the ink collection passage 9, the cleaning passage 14, the exhaust passage 15, the ink separation-collection passage 18, the bypass passage 19, and a not shown electric wiring stored therein. Referring to FIG. 1, the conduit 17 has a short length. However, the actual piping in the inkjet printing device 100 has a long bellows-like shape with a length of approximately 4 m.

<Basic Structure and Basic Operation of Embodiment>

Figure 2:
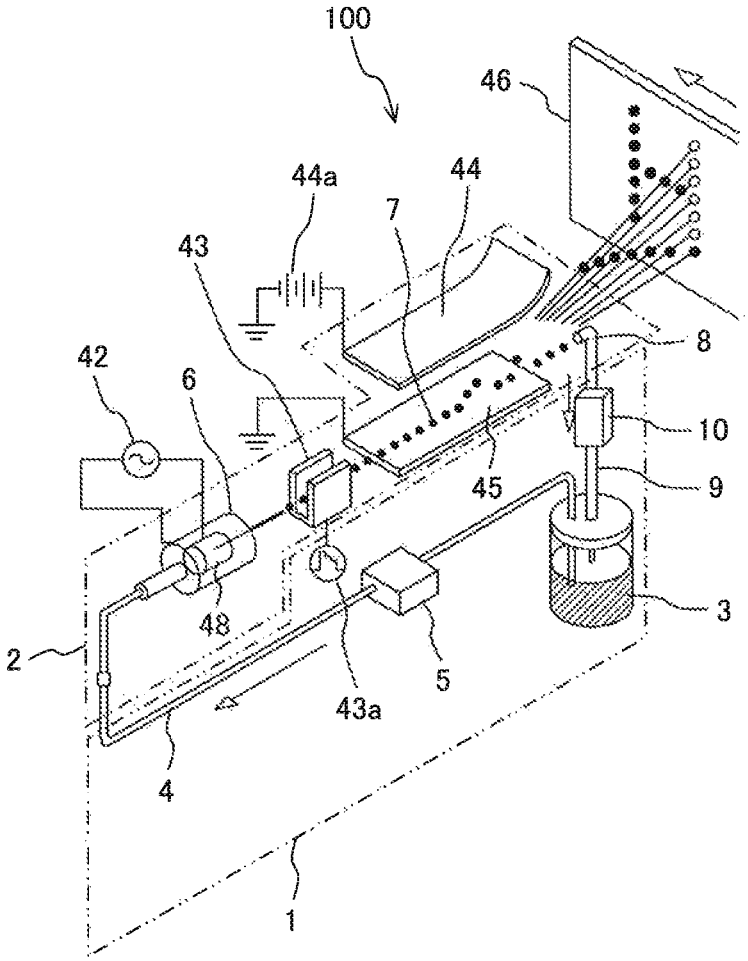
FIG. 2 is a perspective view of a basic structure of the inkjet printing device shown in FIG. 1.

The basic structure and basic operation of the inkjet printing device 100 with the aforementioned components will be described referring to FIG. 2. FIG. 2 is a perspective view representing the basic structure of the inkjet printing device 100 shown in FIG. 1.

The ink container 3 contains ink 3*a*, and is connected to the nozzle 6 via the feed pump 5 through the ink supply passage 4. The feed pump 5 feeds the ink 3*a* contained in the ink container 3 into the nozzle 6 while being pressurized in the ink supply passage 4. The ink supply passage 4 includes a not shown pressure regulating valve for regulating the ink pressure, a pressure gauge for indicating the pressure of the fed ink, the filter for catching the foreign substance contained in the ink and the like.

The nozzle 6 includes a piezoelectric element 48 to which a high frequency sine wave is applied from a power scarce 42 so that the ink is jetted from a concave-like orifice (not shown) at the terminal end of the nozzle 6. The jetted ink is split into particles 7 in the air, and output to a U-like charge electrode 43. The charge electrode 43 is connected to a print signal source 43*a* for applying a print signal voltage to the charge electrode 43 so as to charge the particles 7 jetted from the nozzle 6. The thus charged ink particles 7 are output to the field between an upper deflection electrode 44 and a lower deflection electrode 45.

The upper deflection electrode 44 is connected to a high voltage source 44*a*, and the lower deflection electrode 45 is grounded so that the electrostatic field is generated between the upper deflection electrode 44 and the lower deflection electrode 45. Upon passage of the charged ink particles 7 in the electrostatic field between the upper deflection electrode 44 and the lower deflection electrode 45, the ink particle 7 itself is deflected in accordance with its own electric charge amount. The deflected ink particle 7 adheres onto a print medium 46 for printing an image or a character. Referring to FIG. 2, the ink particles 7 are jetted horizontally. However, it is possible to jet the ink particles 7 vertically.

The ink particle 7 which has not been deflected during passage in the electrostatic field is collected along with air by the gutter 8 with a collection port (not shown). In other words, the gutter 8 is guided into the ink container 3 through the ink collection passage 9 to which the collection pump (first collection pump) 10 is intermediately connected. The ink particle 7 is drawn from the gutter 8 along with air by attraction force of the collection pump 10 so as to be collected into the ink container 3. The thus collected ink particles 7 will be reused.

The ink particles 7 and air are mixed and carried through the ink collection passage 9. As the solvent (ink solvent) of the ink particle 7 exhibits high volatility, the ink solvent partially volatilizes while being carried so as to be mixed with air. Carrying mixture of the ink particles 7 and air may generate the spray of ink mist in the ink collection passage 9. Furthermore, the ink particles 7 are jetted into the ink container 3 from the outlet of the ink collection passage 9 in the ink container 3 along with air, which generates the ink mist as well. The air drawn by the collection pump 10 is continuously fed into the ink container 3. It is therefore necessary to discharge such air from the ink container 3.

<Characteristic Structure of Embodiment>

In this embodiment, referring to FIG. 1, the air accumulated in the ink container 3 passes through the exhaust passage 15 as an arrow Y1 shows, and is sent to the gas-liquid separator 22 for separation between liquid and gas via the ink mist mixer 21 to be described below. The liquid and gas contained in the air are separated so that the exhaust gas in the gaseous phase is discharged as an arrow Y2 indicates. The exhaust gas is drawn by the gutter 8. The exhaust port of the gas-liquid separator 22 for discharging the exhaust gas is directed to the collection port of the gutter 8 so as to be allowed to efficiently draw the exhaust gas. The exhaust side of the gas-liquid separator 22 for discharging the liquid indicated by an arrow Y3 is guided into the ink container 3 through the ink separation-collection passage 18. The ink separation-collection passage 18 is provided intermediately with the electromagnetic valve 13 and the collection pump (second collection pump) 11 in this order.

The orifice formed at the terminal end of the nozzle 6 is connected to an input side of the collection pump 11 in the ink separation-collection passage 18 through the cleaning passage 14. The electromagnetic valve 12 is intermediately disposed between the connected part and the orifice. Furthermore, the bypass passage 19 is connected to an intermediate part of the exhaust passage 15 guided from the ink container 3 via the electromagnetic valve 16 in the branched manner. The bypass passage 19 discharges the exhaust gas to the outside of the inkjet printing device 100.

In the state of the aforementioned structure where the ink particles 7 are mixed with air, and drawn by the collection pump 10 via the gutter 8, the air mixture continuously sent into the ink container 3 is separated into liquid and exhaust gas by the gas-liquid separator 22 through the exhaust passage 15. The exhaust gas is returned to the gutter 8. This makes it possible to reduce the volatilization amount (or leakage amount) of the ink solvent to the outside of the inkjet printing device 100. Such function allows lessening of the environmental load. In the aforementioned case, however, the volatilization amount of the ink solvent cannot be made zero. Therefore, based on the ink density measurement result of the densitometer (not shown) of the ink in the ink container 3, the ink solvent is refilled into the ink container 3 for compensating the shortage by the supply pump 25 from the solvent container 23 through the solvent passage 24.

The inner temperature of the main body 1 having the ink container 3 disposed therein becomes higher than the inner temperature of the print head 2 by approximately 10° C. to 20° C. under the heat generated by a not shown circuit substrate. There may be the case where the exhaust gas passing through the exhaust passage 15 in the main body 1 is cooled in the print head 2 before it is carried into the gutter 8, which may liquefy the ink solvent mixed with the exhaust gas. If such liquefaction occurs, the liquefied ink solvent is separated by the gas-liquid separator 22 so as to be returned into the ink container 3. This makes it possible to reduce the volatilization amount of the ink solvent to the outside of the inkjet printing device 100.

The exhaust gas is generally cooled in accordance with the length of the passage through which the exhaust gas passes. The volatilized ink solvent is likely to be liquefied so as to be easily collected. In this embodiment, the gas-liquid separator 22 for discharging the exhaust gas is disposed close to the gutter 8 most distant from the ink container 3 so that the length of the exhaust passage 15 from the ink container 3 to the gas-liquid separator 22 becomes long.

In the case of clogging of the nozzle 6, the collection pump 11 is activated after closing the electromagnetic valve 13 and opening the electromagnetic valve 12 to draw the clogging substance from the orifice of the nozzle 6 through the cleaning passage 14 for collection into the ink container 3. At this time, when the operator of the inkjet printing device 100 performs the collection while supplying the orifice with the solvent, the clogging in the orifice is more likely to be eliminated.

As described above, the inner temperature of the main body 1 having the ink container 3 disposed therein becomes higher than the inner temperature of the print head 2 by approximately 10° C. to 20° C. Then, the temperature of the exhaust gas in the main body 1 becomes substantially equal to the inner temperature of the ink container 3. The exhaust gas in the exhaust passage 15 within the main body 1 is in the form of the mixture of air, volatilized ink solvent and the ink mist (also referred to as exhaust gas mixture or gas-liquid mixture). If the exhaust gas mixture is returned into the print head 2 directly, the volatilized ink solvent is unlikely to be discharged to the outside of the inkjet printing device 100. It is therefore possible to reduce the volatilization amount of the ink solvent to the outside.

Figure 3:
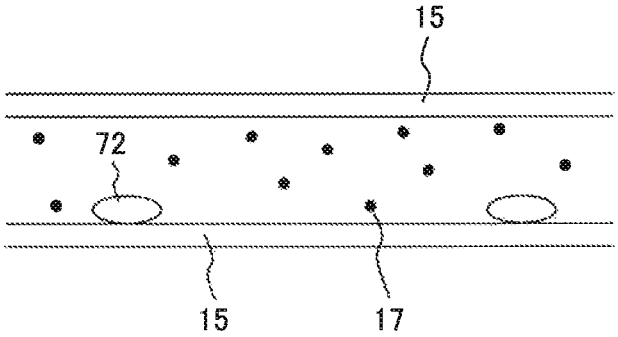
FIG. 3 is a partially sectional view of an exhaust passage in a longitudinal direction.

As the temperature of the exhaust passage 15 in the conduit 17 is lowered, the ink solvent will be partially liquefied as a code 72 (liquefied ink solvent 72) of FIG. 3 shows. FIG. 3 is a partially sectional view of the exhaust passage 15 in the longitudinal direction. The liquefied ink solvent 72 directly returned into the print head 2 as it is may contaminate the inside of the print head 2, or deteriorate printing quality owing to contact between the liquefied ink solvent 72 and the ink particles 7 in the air. The ink mist 71 that exists in the exhaust passage 15 may also contaminate the inside of the print head 2 into which the solvent is returned without removing the ink mist 71.

The ink mist 71 flows along with the exhaust gas in the exhaust passage 15 at approximately 1.5 m/s to 2.0 m/s. The liquefied ink solvent 72 flows along an inner wall of the exhaust passage 15 at the flow rate variable in accordance with the installation direction of the exhaust passage 15. The flow rate is lower than that of the ink mist 71 by 1/10 to 1/30 approximately. The amount of the liquefied ink solvent 72 is in the range from approximately 1 g/h to 10 g/h depending on the temperature of the ink container 3 (temperature of ink container 3: 0° C. to 50° C.).

In this embodiment, the ink mist 71 is removed by the ink mist mixer 21 so that the liquefied ink solvent 72 is separated from the exhaust gas by the gas-liquid separator 22.

<Structure of Ink Mist Mixer 21>

Generally, it is considered to provide the stainless filter which is hardly eroded by the ink solvent in the middle of the exhaust passage 15 as the method for removing the ink mist 71. The plate stainless filter is capable of catching the ink mist 71 flowing in the air at the high rate. However, as the ink mist will be swept by the air stream from behind, it is difficult to remove the ink mist no matter how fine the filter mesh is.

The ink mist mixer 21 is provided while paying attention to the finding that the ink mist 71 in the exhaust gas may be removed by mixing the ink mist 71 with a small amount of the liquefied ink solvent 72 flowing through the exhaust passage 15.

Figure 4:
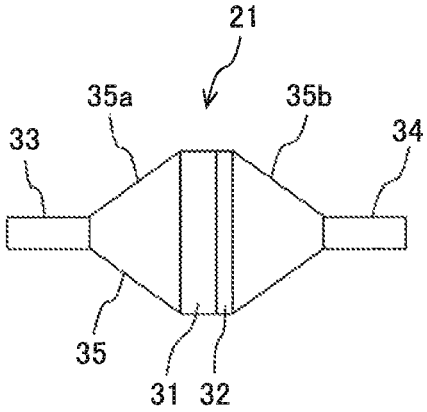
FIG. 4 is a view showing a structure of an ink mist mixer.

FIG. 4 is a view representing a structure of the ink mist mixer 21. The ink mist mixer 21 includes a disc-like liquid holding unit 31 for liquid impregnation, and a disc-like filter 32 bonded to the liquid holding unit 31 with the respective circular surfaces for catching the minute substance generated from the liquid holding unit 31. The mixer further includes a case 35 that stores the bonded liquid holding unit 31 and the filter 32 while being interposed between conical containers 35*a* and 35*b* each with an open top. The opening of the conical container 35*a* of the case 35 is connected to the exhaust passage 15 at the side of the ink container 3 with a cylindrical connector 33, and the opening of the other conical container 35*b* is connected to the exhaust passage 15 at the side of the gas-liquid separator 22 with a cylindrical connector 34.

The liquid holding unit 31 is made of the sheet formed by weaving such material as PTFE (polytetrafluoroethylene) insoluble to the ink solvent and stainless into a yarn to provide excellent ventilation as well as the property for holding liquid in the sheet.

Preferably, the ink mist mixer 21 is located at the position where the ink solvent in the exhaust gas is easily liquefied, that is, just in front of the exhaust gas inlet (at the side of arrow Y1 shown in FIG. 1) of the gas-liquid separator 22. Upon passage through the liquid holding unit 31 wet with the liquefied ink solvent 72 in the exhaust passage 15, the ink mist 71 contained in the gas-liquid mixture is mixed with the liquefied ink solvent 72. The liquid holding unit 31 is continuously supplied with the liquefied ink solvent 72 through the exhaust passage 15 so as to prevent adhesion of the ink mist 71.

<Structure of Gas-Liquid Separator 22>

The gas-liquid separator 22 for separating the liquefied ink solvent 72 from the exhaust gas will be described.

Figure 5A:
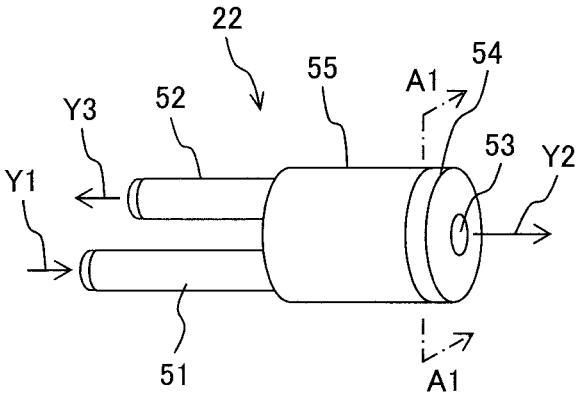
FIG. 5A is a perspective view of an outer appearance of a first gas-liquid separator according to an embodiment of the present invention.
Figure 5B:
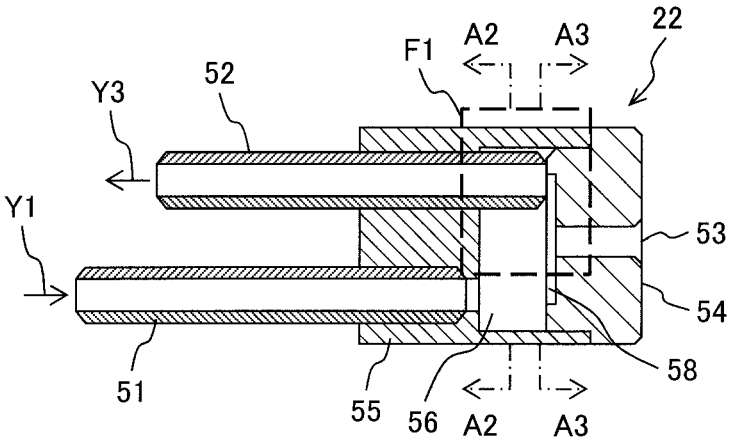
FIG. 5B is a sectional view taken along line A1-A1 of FIG. 5A.
Figure 6A:
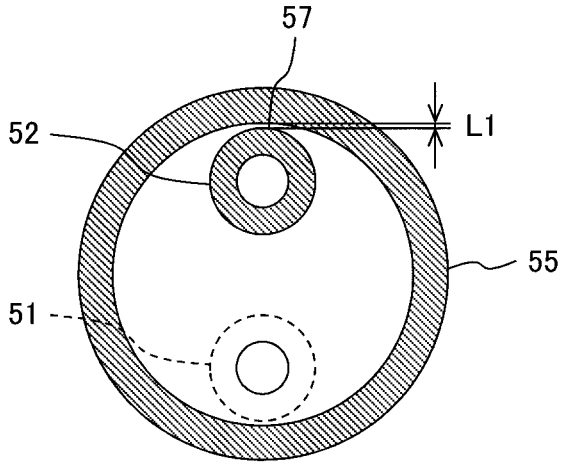
FIG. 6A is a sectional view taken along line A2-A2 of FIG. 5B.
Figure 6B:
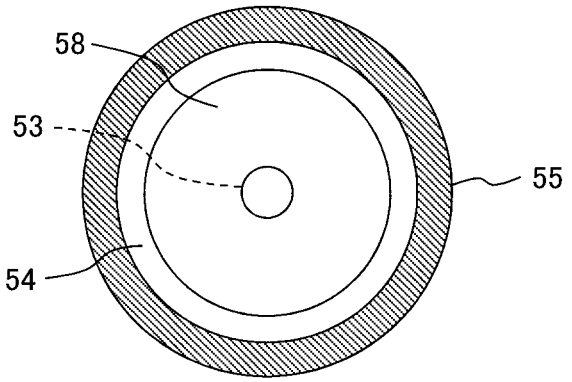
FIG. 6B is a sectional view taken along line A3-A3 of FIG. 5B.

FIG. 5 represents structure of the gas-liquid separator 22. FIG. 5(*a*) is a perspective view of an outer appearance of the gas-liquid separator 22, and FIG. 5(*b*) is a sectional view taken along line A1-A1 of the gas-liquid separator 22 in the longitudinal direction as shown in FIG. 5(*a*). FIG. 6(*a*) is a sectional view taken along line A2-A2 of FIG. 5(*b*), and FIG. 6(*b*) is a sectional view taken along line A3-A3 of FIG. 5(*b*).

Referring to FIG. 5, the gas-liquid separator 22 is configured that a gas-liquid inflow pipe 51 and a gas-liquid outflow pipe 52 each having a cylindrical shape and a circular cross section are inserted into two insertion holes of a columnar case member 55, respectively, and an exhaust port 53 with a circular cross section is formed in the center of a columnar case member 54 having a protrusion fitted with a recess portion of the case member 55 at the other end.

The gas-liquid inflow pipe 51 is connected to the exhaust passage 15 shown in FIG. 1 so that the gas-liquid mixture as the mixture of the ink mist 71 and the liquefied ink solvent 72 with the exhaust gas in the exhaust passage 15 flows in the direction indicated by the arrow Y1. The gas-liquid outflow pipe 52 is connected to the ink separation-collection passage 18 shown in FIG. 1 so that the liquefied ink solvent 72 separated by the gas-liquid separator 22 flows in the direction indicated by the air row Y3. The exhaust gas separated by the gas-liquid separator 22 in the gaseous phase is discharged from the exhaust port 53 to the inside of the print head 2 as indicated by the arrow Y2.

Figure 7:
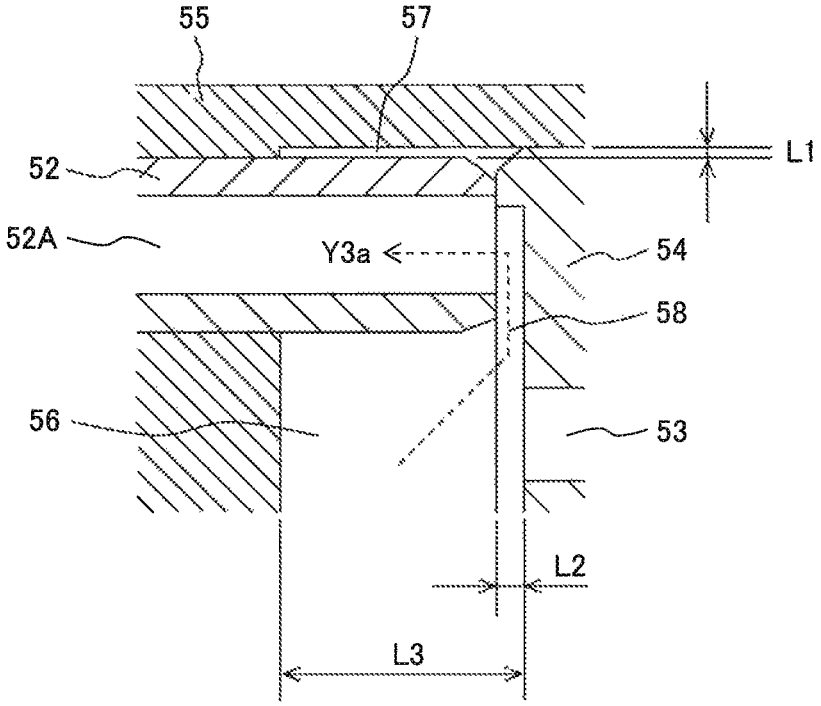
FIG. 7 is a partially sectional view of the gas-liquid separator for explaining the structure thereof.

The case members 54 and 55 are connected in the gas-liquid flow direction as indicated by the arrows Y1 to Y3 so as to form a hollow chamber part (hollow part) 56. FIG. 7 is an enlarged view of the part enclosed by broken line F1 including the chamber part 56. FIG. 7 is a partially sectional view for explaining the gas-liquid separation structure of the gas-liquid separator 22.

Referring to FIG. 7, a gap 57 with an interval L1 is defined by an outer circumferential surface of the gas-liquid outflow pipe 52 and an inner wall of the case member 55. The case member 54 has a stepped portion 58 that circularly recesses in the end surface on which the inlet of the gas-liquid outflow pipe 52 abuts. The stepped portion 58 circularly recesses in the protruding circular end portion of the case member 54, which is fitted with the recess portion of the case member 55 as shown in FIG. 6(*b*). Further specifically, the stepped portion circularly recesses concentrically with the exhaust port 53 positioned at the center of the case member 54. The stepped portion 58 has an interval L2 as shown in FIG. 7 as viewed from the lateral side of the exhaust passage. As indicated by an arrow Y3*a*, the stepped portion 58 allows easy discharge of the liquefied ink solvent 72 contained in the gas-liquid mixture into a passage 52A inside the gas-liquid outflow pipe 52.

Referring to FIG. 7, the chamber part 56 has an interval L3 as length in the gas-liquid flow direction, into which the gas-liquid mixture flows from the gas-liquid inflow pipe 51 as indicated by the arrow Y1 (refer to FIG. 5(*b*)). The liquid component of the gas-liquid mixture is held in the gap 57 while passing through the stepped portion 58 using capillary action. As described above, liquid is kept away from the exhaust port 53 as the liquid component is held. Referring to FIGS. 7 and 6(*a*), the gap 57 is defined by the outer circumferential surface of the gas-liquid outflow pipe 52 and the inner circumferential surface (inner wall) of the case member 55. As the interval L1 becomes narrower, the retentivity of the liquid into the gap 57 is strengthened, narrowing of the interval L1 allows the gas-liquid separation regardless of installation posture of the gas-liquid separator 22.

The liquefied ink solvent 72 contained in the gas-liquid mixture flowing into the gas-liquid separator 22 from the gas-liquid outflow pipe 52 as indicated by the arrow Y3 is sent to the gas-liquid outflow pipe 52 while passing through the stepped portion 58 and being held in the gap 57 with the interval L1 as indicated by the arrow Y3*a* so as to be collected into the ink container 3.

Figure 8:
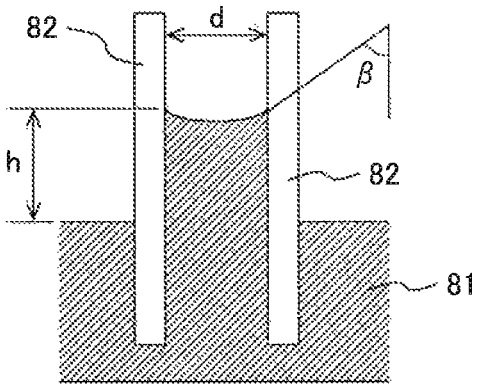
FIG. 8 is an explanatory view representing a relationship of an interval L1 between an outer circumferential surface of a gas-liquid outflow pipe and an inner wall of a case member of the gas-liquid separator, and liquid retentivity.

The relationship between the interval L1 of the gap 57 and the retentivity will be described referring to FIG. 8. FIG. 8 is an explanatory view with respect to the relationship of the liquid retentivity with the interval L1 of the gap 57 between the outer circumferential surface of the gas-liquid outflow pipe 52 and the inner wall of the case member 55 of the gas-liquid separator 22.

The liquid 81 rises to the level h by the capillary action between two flat plates 82 which stand in the liquid 81 at an interval d. Assuming that the surface tension of the liquid 81 is set to Γ, the contact angle of the liquid 81 with the flat plate 82 is set to β, the density of the liquid 81 is set to ρ, and the gravitational acceleration is set to g, the height h may be expressed by the following formula (1).

$$h=2\Gamma\cos\beta/d\rho g \quad (1)$$

For example, the height of approximately 5 mm (h=5 mm) may be derived from usage of methylethylketone for the liquid 81, and setting of d=0.5 mm. Accordingly, the interval L3 may be set to 5 mm or shorter if the interval L1 is set to 0.5 mm. Those values are derived from experimental results.

In the embodiment, the gas-liquid outflow pipe 52 is not a flat plate but has a cylindrical shape, which may generate the large interval L1 of the liquid holding part. The liquid retentivity is weakened in this part. However, it has been confirmed that the gas-liquid separation is possible by setting the interval L3 to 3 mm approximately regardless of the installation posture of the gas-liquid separator 22. The interval L2 is set to the value equal to or smaller than the interval L1 so as to stabilize the gas-liquid separation performance.

<Installation Method of Gas-Liquid Separator 22>

Figure 9:
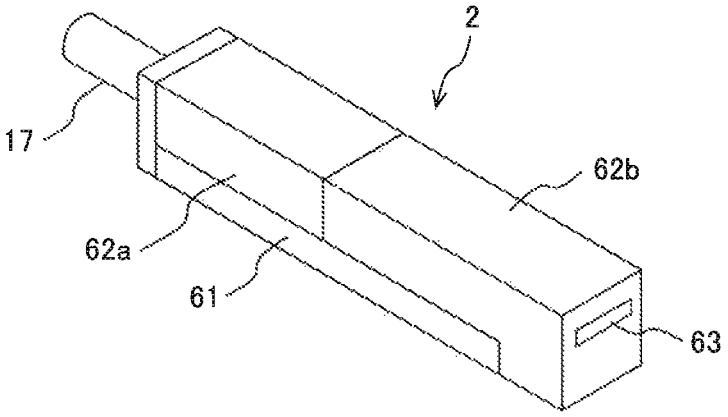
FIG. 9 is a perspective view of an outer appearance of a print head.

FIG. 9 is a perspective view of an outer appearance of the print head 2. Referring to FIG. 9, the print head 2 is connected to the conduit 17 in connection with the main body 1 (refer to FIG. 1), and has a head cover 62*a* and a head cover 62*b* with a slit 63 on a pedestal 61.

Figure 10A:
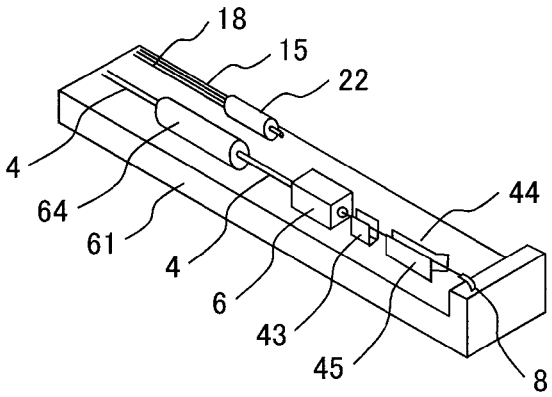
FIG. 10A is a perspective view representing an arrangement of the gas-liquid separator 22 disposed in the print head.
Figure 10B:
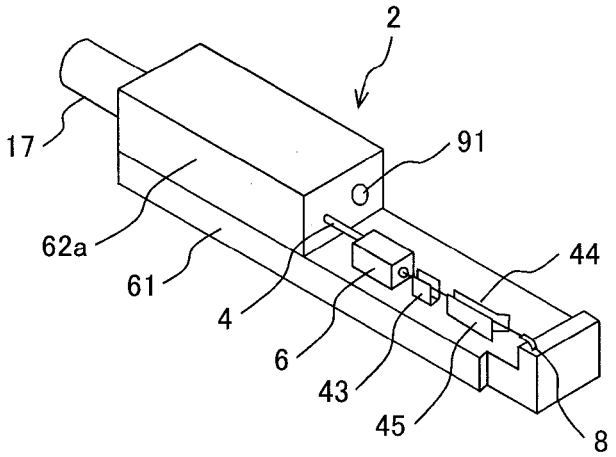
FIG. 10B is a view representing the state where the head cover is provided.

FIG. 10 represents the method of disposing the gas-liquid separator in the print head 2. FIG. 10(*a*) represents the state where the head covers 62*a* and 62*b* are removed from the print head 2 as described referring to FIG. 9. As FIG. 10(*a*) shows, the gas-liquid separator 22 to which the exhaust passage 15 and the ink separation-collection passage 18 are connected is disposed on the flat surface of the pedestal 61 along the gas-liquid flow direction. The nozzle 6 to which the ink supply passage 4 is connected is disposed in parallel with the gas-liquid separator 22. The charge electrode 43, a pair of upper deflection electrode 44 and lower deflection electrode 45, and the gutter 8 and disposed in this order at the top end side of the nozzle 6.

Accordingly, the ink particles 7 jetted from the nozzle 6 pass through the charge electrode 43, and the field between the upper deflection electrode 44 and the lower deflection electrode 45, and are discharged from the slit 63 so that printing is performed on the print medium 46 as shown in FIG. 2.

Figure 12:
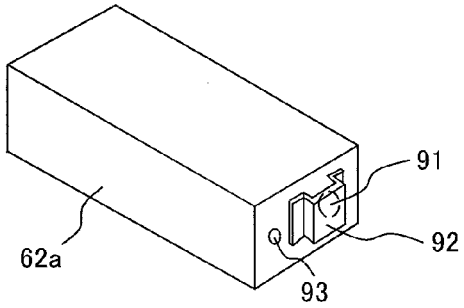
FIG. 12 is a perspective view showing a configuration of the head cover in the state where the gas-liquid separator 22 is disposed in the print head shown in FIG. 11.

As described referring to FIGS. 1 and 5, the ink solvent is partially liquefied during passage of the exhaust gas from the ink container through the exhaust passage 15, and the liquefied solvent is separated by the gas-liquid separator 22 so as to be returned into the ink container through the ink separation-collection passage 18. The exhaust gas separated from the liquefied solvent is discharged from the exhaust port 53. However, use of the inkjet printing device in the high temperature environment (for example, 45° C.) will increase the amount of the ink solvent in the exhaust gas as well as the amount of the ink solvent liquefied during passage through the exhaust passage. This may cause the ink solvent to be dripped along with the exhaust gas from the exhaust port 53. If the print head 2 is directed downward (the slit 63 of the cover 62*b* is formed at the lower part), the ink solvent may be brought into contact with the deflection electrode 44 which exists on the pedestal 61 of the print head 2. If the ink solvent is in contact with the deflection electrode 44 to which high voltage is applied, the predetermined voltage is no longer applied. Therefore, the deflection amount of the ink droplet is reduced, resulting in deteriorated printing state. For the purpose of coping with the problem, it is necessary to prevent dripping of the ink solvent from the exhaust port 53. As FIG. 10(*b*) shows, an opening 91 is formed in the head cover 62*a*, and a drip prevention unit 92 is disposed at the rear stage of the opening as FIG. 12 shows. The drip prevention unit 92 is joined with the head cover 62*a* with screwing, welding, adhesion and the like. Position of the drip prevention unit 92 may generate turbulence in the exhaust gas flow. However, the exhaust gas is collected by the gutter 8 in the print head 2 and guided into the ink container. The ink solvent is dripped to the drip prevention unit 92. The drip amount of the ink solvent per unit time is very small, which will be volatilized and collected by the gutter.

As described above, the drip prevention unit 92 disposed for the gas-liquid separator 22 prevents the contact between the ink solvent and the deflection electrode 44 in the print head 2, thus ensuring the stable printing.

Another method of preventing the solvent from dripping into the print head through the exhaust port 53 of the gas-liquid separator will be described.

Figure 16:
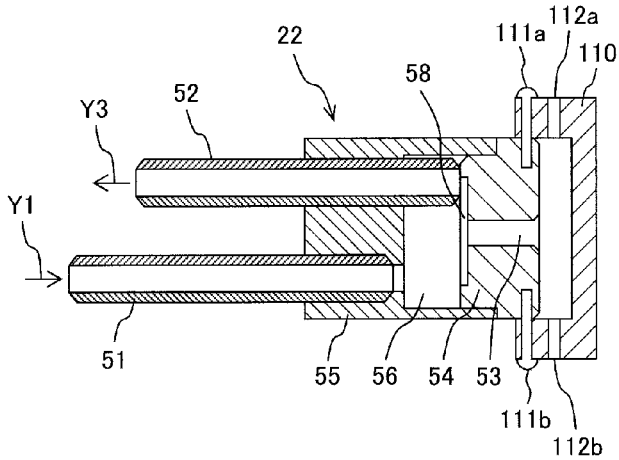
FIG. 16 is a view representing a drip prevention unit disposed at the rear stage of the gas-liquid separator according to the embodiment of the present invention.

FIG. 16 is a view representing the method of connecting the drip prevention unit at the rear stage of the gas-liquid separator. A drip prevention unit 110 is fixed to the gas-liquid separator 22 at the side of the exhaust port 53 with screws 111*a* and 111*b*. The drip prevention unit 110 is provided with vent holes 112*a* and 112*b* at locations so as to prevent the droplet from dripping in the case where the print head 2 is directed downward. The above structure allows discharge of the exhaust gas from the exhaust port 53 of the gas-liquid separator 22 through the vent holes 112*a* and 112*b* during operation of the inkjet printing device. The discharged exhaust gas is collected by the gutter 8 in the print head 2 and guided into the ink container.

Another structure for preventing the solvent from dripping into the print head through the gas-liquid separator 22 will be described.

Example 2

Figure 17A:
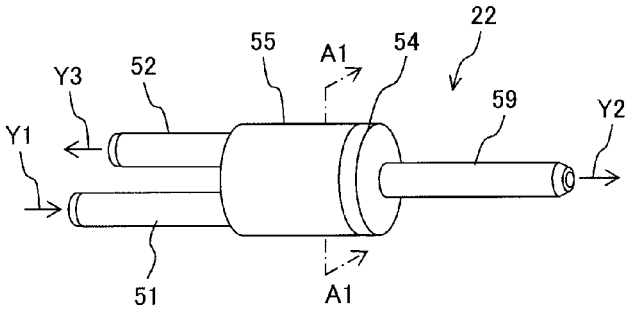
FIG. 17A shows an outer appearance of a second gas-liquid separator according to an embodiment of the present invention.
Figure 17B:
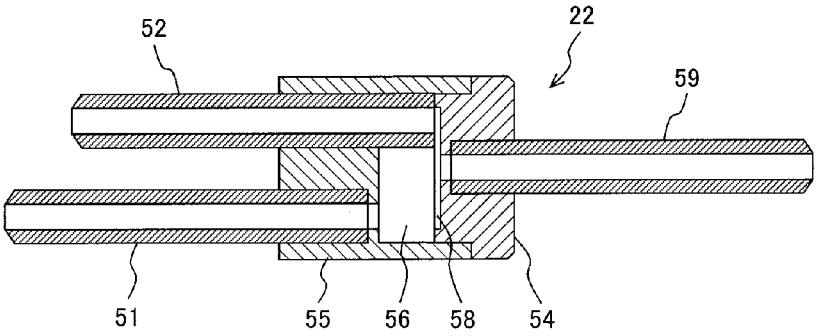
FIG. 17B is a sectional view taken along line A1-A1 of FIG. 17A.

FIG. 17 shows a structure of the gas-liquid separator 22, which is different from the one shown in FIG. 5. FIG. 17(*a*) is a perspective view of an outer appearance of the gas-liquid separator 22, and FIG. 17(*b*) is a sectional view taken along line A1-A1 by cutting the gas-liquid separator 22 shown in FIG. 17(*a*) along the longitudinal direction. Referring to the example shown in FIG. 17, a cylindrical exhaust pipe 59 is inserted into an insertion hole of the columnar case member 55. Upon operation of the inkjet printing device, the exhaust gas from the gas-liquid separator 22 is discharged from the exhaust pipe 59.

Figure 11A:
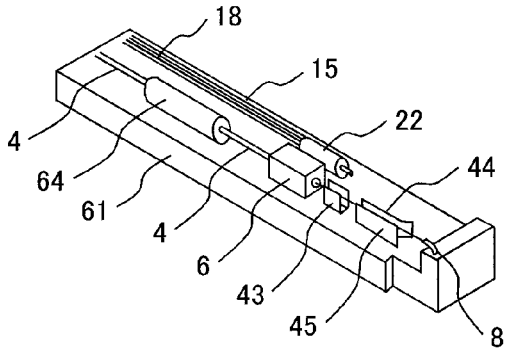
FIG. 11A is a perspective view representing another arrangement of the gas-liquid separator 22 different from the one shown in FIG. 10A.
Figure 11B:
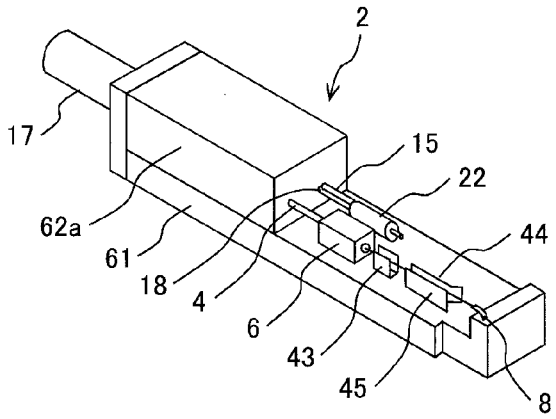
FIG. 11B is a view representing the state where the head cover is provided.

FIG. 11(*a*) is a view of the structure having the gas-liquid separator 22 shown in FIG. 17 disposed on the pedestal 61 of the print head in the state where the head covers 62*a* and 62*b* are removed from the print head 2 as described referring to FIG. 9. FIG. 11(*b*) represents the state where the head cover 62*a* is provided on the structure shown in FIG. 11(*a*). As FIG. 11(*b*) shows, the gas-liquid separator 22 is disposed outside the head cover 62*a*.

Figure 18A:
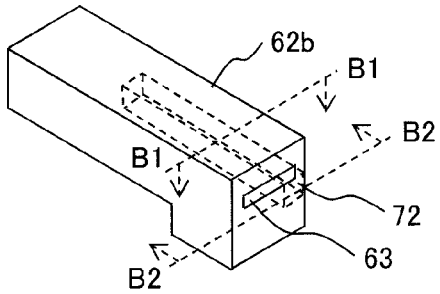
FIG. 18A is a view representing a drip prevention unit provided in the head cover for the gas-liquid separator as the second structure according to the embodiment of the present invention.
Figure 18B:
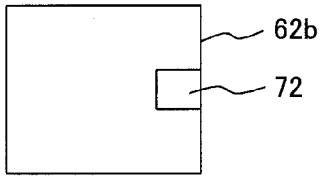
FIG. 18B is a sectional view taken along line B1-B1 of FIG. 18A.
Figure 18C:
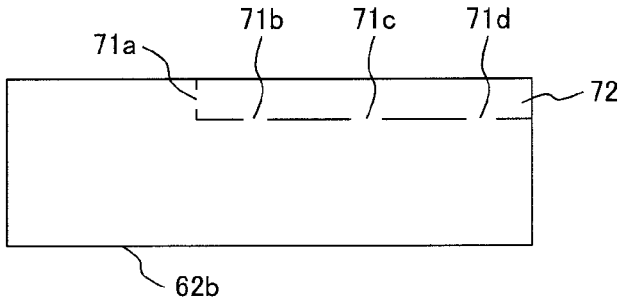
FIG. 18C is a sectional view taken along line B2-B2 of FIG. 18A.

FIG. 18 shows a structure of the head cover 62*b* employed for the gas-liquid separator 22 shown in FIG. 17. FIG. 18(*a*) is a perspective view of an outer appearance of the head cover 62*b*. FIG. 18(*b*) is a sectional view taken along line B1-B1 of FIG. 18(*a*), and FIG. 18(*c*) is a sectional view taken along line B2-B2.

The leading end of the exhaust pipe 59 of the gas-liquid separator 22 is inserted into an opening 71*a* of the drip prevention unit 72 disposed inside the head cover 62*b* as shown in FIG. 18(*c*). The exhaust gas discharged from the exhaust pipe 59 of the gas-liquid separator 22 flows into the print head through openings 71*b*, 71*c* and 71*d*, and is collected by the gutter and guided into the ink container. The ink solvent dripped from the exhaust pipe 59 is dried and then volatilized inside the drip prevention unit 72. The aforementioned structure is configured to prevent the solvent droplet from dripping into the print head.

Another structure for preventing the solvent droplet from dripping into the print head through the gas-liquid separator 22 will be described.

Example 3

Figure 19:
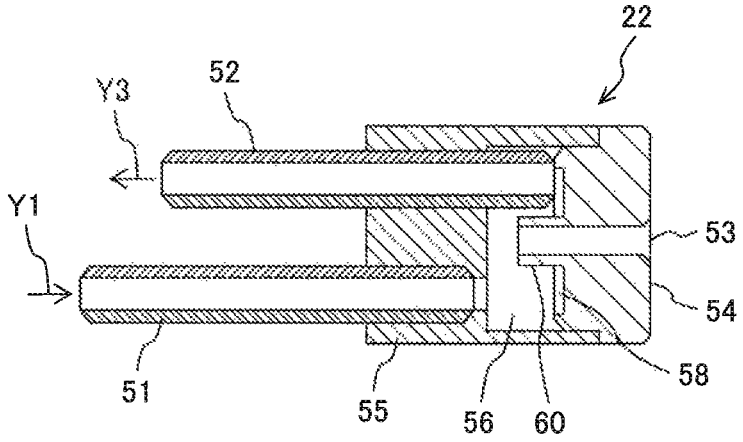
FIG. 19 is a view representing the gas-liquid separator as the third structure according to an embodiment of the present invention.

FIG. 19 shows the gas-liquid separator 22 differently configured from the one shown in FIG. 5. The separator has the same outer appearance, but has a protruding portion 60 on the center of the columnar case member 54. Use of the inkjet printing device in the high-temperature environment (for example, 45° C.) increases the amount of the ink solvent contained in the exhaust gas as well as the amount of the ink solvent liquefied during passage through the exhaust passage. The liquefied solvent spreads wettedly in the stepped portion 58, and drawn and collected from the gas-liquid outflow pipe 52. If the amount of the ink solvent is large, there may be the case where the ink solvent proceeds to the exhaust port 53 along with the exhaust gas. The protruding portion 60 may prevent advancement of the ink solvent to the exhaust port. This makes it possible to prevent dripping of the ink solvent from the exhaust port 53.

The drip prevention unit 110 shown in FIG. 16 may be connected to the top end portion of the exhaust port 53 of the gas-liquid separator 22 shown in FIG. 19. The protruding portion 60 may be disposed on the center of the case member 54 of the gas-liquid separator 22 as shown in FIG. 17.

A method of controlling the inkjet printing device will be described.

Figure 13:
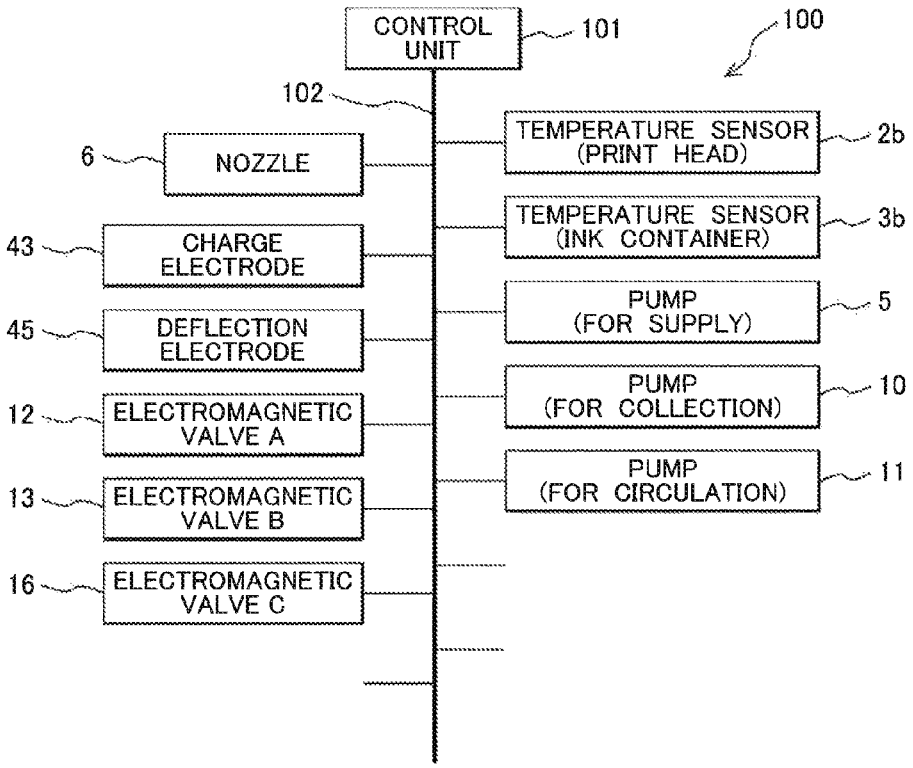
FIG. 13 is a block diagram showing a structure for connection between a control unit and controlling elements.

The inkjet printing device 100 includes a control unit 101 as shown in FIG. 13. FIG. 13 is a block diagram representing the structure for connection between the control unit and the controlled elements. The control unit 101 is connected to the nozzle 6, the charge electrode 43, the upper deflection electrode 44, the lower deflection electrode 45, the electromagnetic valves 12, 13 and 16, a temperature sensor 2*b* of the print head 2, a temperature sensor 3*b* of the ink container 3, the feed pump 5, and the collection pumps 10 and 11 through a bus 102 so that those elements are controlled.

Figure 14:
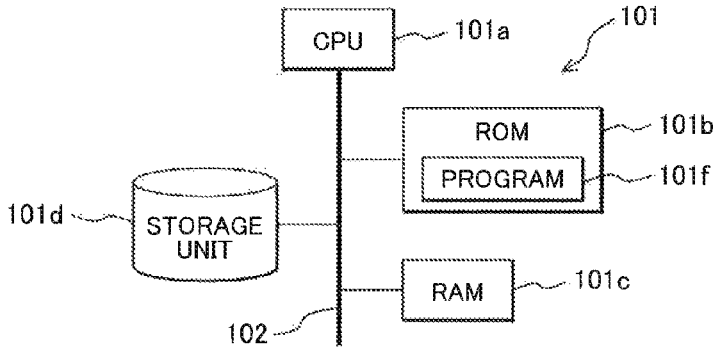
FIG. 14 is a block diagram showing a structure of the control unit.

FIG. 14 is a block diagram representing the structure of the control unit. That is, the control unit 101 includes a CPU (Central Processing Unit) 101*a*, a ROM (Read Only Memory) 101*b*, a RAM (Random Access Memory) 101*c*, and a storage unit (HDD: Hard Disk Drive and the like) 101*d* as shown in FIG. 14. Generally, those components 101*a* to 101*d* are connected with one another with the bus 102. For example, the control unit is configured to allow the CPU 101*a* to implement various kinds of controlling operations as described above or to be described below by executing a program 101*f* written in the ROM 101*b*.

<Operation of Embodiment>

The control for printing operations of the inkjet printing device 100 as described above will be executed by the control unit 101 to be described below.

Figure 15:
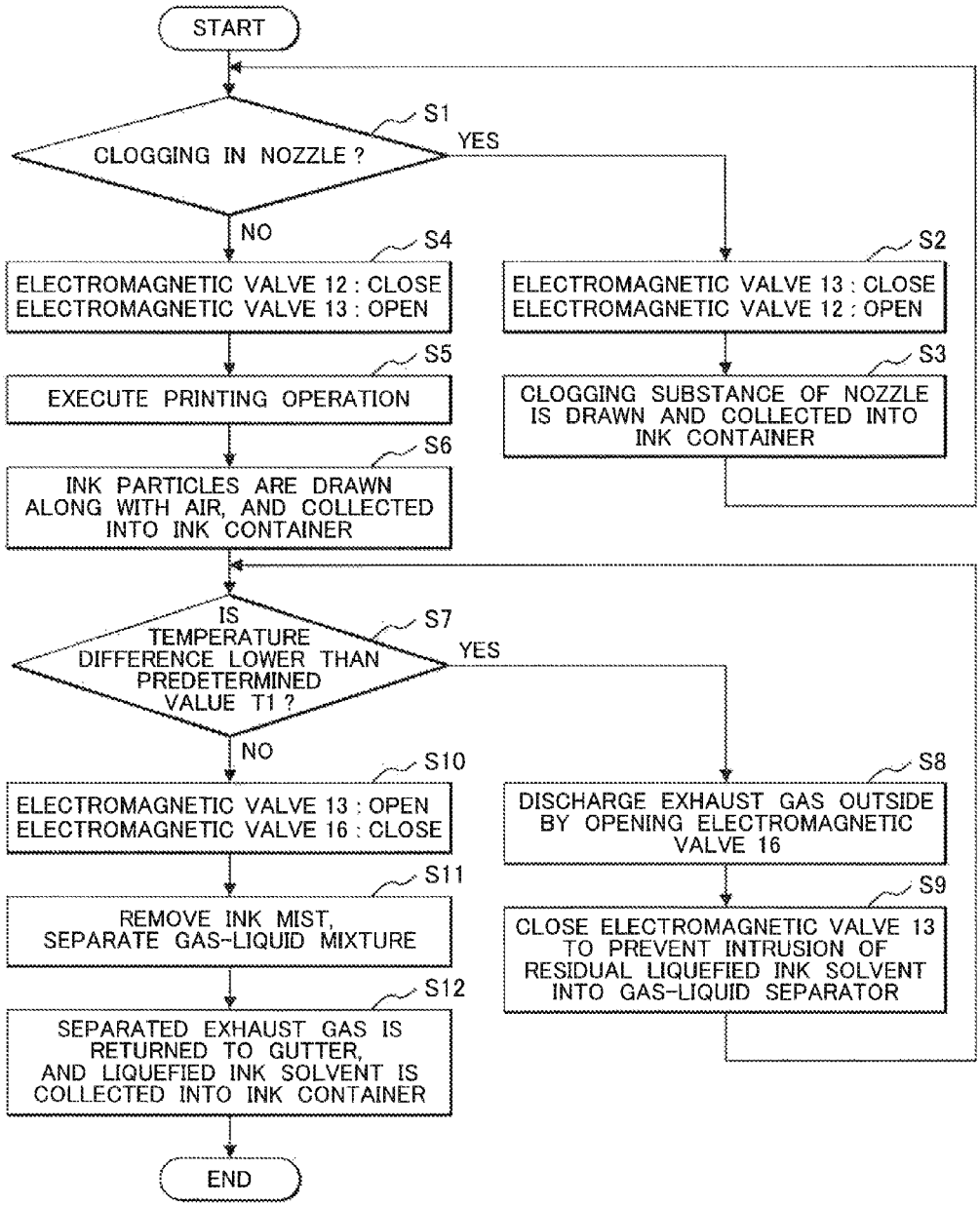
FIG. 15 is a flowchart for explaining the control of the inkjet printing operation, which is performed by the control unit of the inkjet printing device according to the embodiment.

FIG. 15 is a flowchart for explaining the control for the inkjet printing operation of the inkjet printing device 100, which is executed by the control unit 101.

Upon start of the inkjet printing device 100 shown in FIG. 1 for the printing operation, in step S1, it is determined whether or not the nozzle 6 has clogging. If it is determined that the clogging exists, the electromagnetic valve 13 is closed, and the electromagnetic valve 12 is opened in step S2. Then in step S3, the clogging substance in the nozzle 6 is drawn by the suction force of the collection pump 11 so as to be swept into the cleaning passage 14, and further collected into the ink container 3. After the collection, the process returns to step S1 for determination.

Meanwhile, if it is determined that the clogging does not exist, the electromagnetic valve 12 is closed and the electromagnetic valve 13 is opened in step S4. Then in step S5, the printing operation is performed. That is, the ink 3*a* in the ink container 3 is fed to the nozzle 6 under the pressure applied by the feed pump 5 through the ink supply passage 4. The thus fed ink is jetted through the orifice of the nozzle 6, and is split into particles 7 in the air as shown in FIG. 2. They are charged by the charge electrode 43 into the ink particles 7. The ink particles 7 are deflected while passing in the electrostatic field between the upper deflection electrode 44 and the lower deflection electrode 45 to adhere onto the print medium 46 for printing letters and images.

During the printing operation as described above, in step S6, the ink particles 7 are drawn from the gutter 8 along with air by the suction force of the collection pump 10 through the ink collection passage 9 as shown in FIG. 1, and collected into the ink container 3.

In step S7, it is determined whether or not the temperature difference derived from subtracting the temperature of the print head 2 from the temperature of the ink container 3 is smaller than a predetermined value (preset value) T1. Specifically, the temperature detected by the temperature sensor 2*b* provided in the print head 2 is subtracted from the temperature detected by the temperature sensor 3*b* provided in the ink container 3. It is determined whether the temperature difference as the subtraction result is smaller than the preset value T1 by making the comparison. As a result, if the temperature difference is determined to be smaller than the present value, the electromagnetic valve 16 is opened in step S8 so that the exhaust gas discharged from the ink container 3 through the exhaust passage 15 is discharged to the outside through the bypass passage 19.

Simultaneously, in step S9, the electromagnetic valve 13 is also closed so as to prevent the residual liquefied ink solvent 72 in the exhaust passage 15 from intruding into the gas-liquid separator 22. After closing the electromagnetic valve 13, the process returns to step S7 for determination.

The state where the temperature difference is determined to be smaller than the preset value T1 represents that the period of time elapsing from the start of the inkjet printing device 100 is insufficient. In such a case, the inner temperature of the main body 1 has not increased, and accordingly, the temperature difference between the ink container 3 and the print head 2 is still small. The amount of the ink solvent to be liquefied from the exhaust gas mixture sent from the ink container 3 to the print head 2 is small in the exhaust passage 15.

If the amount of the liquefied ink solvent is small, the liquid holding unit 31 of the ink mist mixer 21 is not sufficiently wetted, which may cause the risk of adhesion of the ink mist 71 to the liquid holding unit 31. If the temperature difference is determined to be smaller than the preset value T1, the electromagnetic valve 16 is opened to send the exhaust gas into the bypass passage 19 in step S8 so as to control the exhaust gas not to flow into the ink mist mixer 21. Simultaneously, as in step S9, the electromagnetic valve 13 is also closed to prevent the residual liquefied ink solvent 72 in the exhaust passage 15 from intruding into the gas-liquid separator 22.

Meanwhile, the temperature difference will be determined to be equal to or larger than the preset value T1 in step S7 when the inner temperature of the main body 1 is increased after an elapse of several hours from the start of the inkjet printing device 100.

In this case, the electromagnetic valve 13 is opened, and the electromagnetic valve 16 is closed in step S10. Then in step S11, the exhaust gas mixture (gas-liquid mixture) discharged from the ink container 3 through the exhaust passage 15 is sent to the ink mist mixer 21 and the gas-liquid separator 22. By sending the gas, the ink mist 71 (refer to FIG. 3) is removed from the gas-liquid mixture by the ink mist mixer 21. Then the gas-liquid mixture, having the ink mist 71 removed is separated by the gas-liquid separator 22 into the liquefied ink solvent 72 (refer to FIG. 3) and the exhaust gas in the gaseous phase. In step S12, the separated exhaust gas is returned to the gutter 8, and the liquefied ink solvent 72 is drawn by the collection pump 11 through the ink separation-collection passage 18 so as to be collected into the ink container 3.

Advantageous Effect of Embodiment

The inkjet printing device 100 according to the embodiment is configured to jet the ink fed from the ink container 3 from the nozzle 6, and to allow the gutter 8 to draw the ink particles 7 which have not been used for printing along with air for collection into the ink container 3. The air collected along with the ink solvent is discharged from the ink container 3 as the exhaust gas via the exhaust passage 15. At this time, the liquefied ink solvent in the exhaust passage 15 is separated by the gas-liquid separator 22 from the exhaust gas in the gaseous phase, while being retained using capillary action. The separated liquefied ink solvent is collected into the ink container 3.

The gas-liquid separator 22 includes the cylindrical gas-liquid inflow pipe 51 connected to the exhaust passage 15, the cylindrical gas-liquid outflow pipe 52 connected to the ink separation-collection passage 18, the annular exhaust port 53 for discharging the exhaust gas in the gaseous phase, and the case members 54 and 55 which have the inner chamber part 56 into which the gas-liquid inflow pipe 51 and the gas-liquid outflow pipe 52 are inserted in parallel from one outer direction, and have the exhaust port 53 from the other direction opposite the one direction. The case member 54 has the stepped portion 58 in an end surface of the part where the exhaust port 53 is located, opposite an open end of the gas-liquid outflow pipe 52, which has the predetermined interval L2 from the open end. The gap 57 is formed between the inner wall of the case member 55 and the outer circumference of the gas-liquid outflow pipe 52, which has the predetermined interval L1.

Therefore, the gas-liquid separator 22 allows appropriate separation of the ink solvent liquefied in the exhaust passage 15 from the exhaust gas in the gaseous phase. Generally, upon gas-liquid separation, the liquid component which has been dripped by the force of gravity is collected. If the installation direction of the gas-liquid separator is changed, the gas-liquid separation cannot be performed. The gas-liquid separator 22 according to the embodiment is configured to perform the separation of the gas from the liquid component while being retained using capillary action. It is therefore possible to perform the appropriate separation irrespective of the changed installation direction of the gas-liquid separator 22.

In the case where the temperature of the environment where the inkjet printing device is used becomes high, the amount of the ink solvent contained in the exhaust gas becomes large to increase the amount of the ink solvent that is liquefied during passage through the exhaust passage. This may cause dripping of the ink solvent along with the exhaust gas from the exhaust port 53, resulting in the risk of contacting the solvent with the electrode in the print head. The drip prevention unit 95 is provided at the rear stage of the exhaust port of the gas-liquid separator 22 so as to prevent the contact between the ink solvent and the deflection electrode 44 in the print head 2, resulting in stable printing.

In the case where the exhaust part of the gas-liquid separator 22 is cylindrical (pipe) rather than a hole, the head cover is provided, which is configured to connect the top end of the pipe with the drip prevention unit so as to prevent the contact between the ink solvent and the deflection electrode 44 in the print head 2 as described above, resulting in stable printing.

The protruding portion 60 provided inside the gas-liquid separator 22 serves to prevent the ink solvent from advancing to the exhaust port. This makes it possible to prevent dripping of the ink solvent from the exhaust port 53, and contact between the ink solvent and the deflection electrode 44, resulting in stable printing.

The present invention which is not limited to the aforementioned embodiments includes various kinds of modifications. For example, the aforementioned embodiments have been described in detail for easy understanding of the present invention. Therefore, it is not necessarily limited to be configured to have all the components as described above.

The respective structures, functions, processing parts (control unit), processing means and the like may be realized through hardware by designing those elements partially or entirely using the integrated circuit. The respective structures and functions may also be realized through software by interpreting and executing the program for the processor to implement the respective functions. Information on the program, table, file and the like for realizing the respective functions may be stored in the storage unit such as the memory, hard disk, SSD (Solid State Drive), or a recording medium such as IC (Integrated Circuit) card, SD (Secure Digital memory) card, and DVD (Digital Versatile Disc).

The control line and information line considered as necessary are only shown. They do not necessarily indicate all the control and information lines for the product. Actually, it may be considered that almost all the components are connected with one another.

REFERENCE SIGNS LIST

3 . . . ink container,
3*a* . . . ink,
4 . . . ink supply passage,
5 . . . feed pump,
6 . . . nozzle
8 . . . gutter,
9 . . . ink collection passage,
10, 11 . . . collection pump (first collection pump, second collection pump),
12, 13, 16 . . . electromagnetic valve,
15 . . . exhaust passage,
18 . . . ink separation-collection passage,
21 . . . ink mist mixer,
22 . . . gas-liquid separator,
51 . . . gas-liquid inflow pipe,
52 . . . gas-liquid outflow pipe,
53 . . . exhaust port,
54, 55 . . . case member,
56 . . . chamber part,
59 . . . exhaust pipe,
72 . . . liquefied ink solvent,
100, 100A . . . inkjet printing device.

The invention claimed is:

1. An inkjet printing device comprising:
an ink container which stores ink;
a nozzle which jets the ink for printing on a printing object;
a feed pump for feeding the ink from the ink container to the nozzle through an ink supply passage;
a gutter which draws the ink jetted from the nozzle and unused for the printing along with air;
a print head which stores the nozzle and the gutter;
a first collection pump which sends the ink drawn by the gutter along with air to the ink container for collection through an ink collection passage;
an exhaust passage which discharges the air as exhaust gas from the ink container, which has been mixed with an ink solvent and collected into the ink container;
a gas-liquid separator for separating the exhaust gas from liquefied ink solvent formed by liquefaction of the ink solvent contained in the exhaust gas in the exhaust passage using capillary action;
a second collection pump which sends the liquefied ink solvent separated by the gas-liquid separator for collection into the ink container through an ink separation-collection passage; and
a drip prevention unit provided at a rear stage where the exhaust air is discharged from the gas-liquid separator.

2. The inkjet printing device according to claim 1, wherein:
the gas-liquid separator includes a cylindrical gas-liquid inflow pipe connected to the exhaust passage, a cylindrical gas-liquid outflow pipe connected to the ink separation-collection passage, an exhaust port for discharging the exhaust gas, a case member A having a hollow part into which the gas-liquid inflow pipe and the gas-liquid outflow pipe are inserted in parallel with each other from one outer direction, and a case member B having the exhaust port in a surface opposite the one direction; and
the case member B has a stepped portion with a predetermined interval L2 between an end surface opposite an open end of the gas-liquid outflow pipe at a position where the exhaust port exists and the open end, and a gap with a predetermined interval L1 between an inner wall of the case member A and an outer circumference of the gas-liquid outflow pipe.

3. The inkjet printing device according to claim 2, wherein the drip prevention unit having a vent hole is fixed to the rear stage of the exhaust port of the gas-liquid separator.

4. The inkjet printing device according to claim 2, wherein the drip prevention unit is provided to a cover of the print head at a position in contact with the exhaust gas from the exhaust port of the gas-liquid separator.

5. The inkjet printing device according to claim 1, wherein:
the gas-liquid separator includes a cylindrical gas-liquid inflow pipe connected to the exhaust passage, a cylindrical gas-liquid outflow pipe connected to the ink separation-collection passage, a cylindrical exhaust outlet pipe for discharging the exhaust gas, a case member A having a hollow part into which the gas-liquid inflow pipe and the gas-liquid outflow pipe are inserted in parallel with each other from one outer direction, and a case member B having the exhaust outlet pipe in a surface opposite the one direction; and
the case member B has a stepped portion with a predetermined interval L2 between an end surface opposite an open end of the gas-liquid outflow pipe at a position where the exhaust port exists and the open end, and a gap with a predetermined interval L1 between an inner wall of the case member A and an outer circumference of the gas-liquid outflow pipe.

6. The inkjet printing device according to claim 5, wherein the drip prevention unit is provided to a cover of the print head, and has a plurality of openings, one of which accommodates insertion of the exhaust outlet pipe of the gas-liquid separator.

7. The inkjet printing device according to claim 1, wherein:
the gas-liquid separator includes a cylindrical gas-liquid inflow pipe connected to the exhaust passage, a cylindrical gas-liquid outflow pipe connected to the ink separation-collection passage, an exhaust port for discharging the exhaust gas, a case member A having a hollow part into which the gas-liquid inflow pipe and the gas-liquid outflow pipe are inserted in parallel with each other from one outer direction, and a case member B having the exhaust port in a surface opposite the one direction; and
the case member B has a protruding portion on a surface opposite an open end of the gas-liquid outflow pipe, the center of which has the exhaust port, and a gap with a predetermined interval L1 is formed between an inner wall of the case member A and an outer circumference of the gas-liquid outflow pipe.

* * * * *